US011156035B2

(12) United States Patent
Short, Jr. et al.

(10) Patent No.: US 11,156,035 B2
(45) Date of Patent: Oct. 26, 2021

(54) METHOD AND APPARATUS FOR REAMING WELL BORE SURFACES NEARER THE CENTER OF DRIFT

(71) Applicant: Extreme Technologies, LLC, Vernal, UT (US)

(72) Inventors: Lot William Short, Jr., Garland, TX (US); Robert Bradley Beggs, Rowlett, TX (US); Richard Earl Beggs, Rowlett, TX (US)

(73) Assignee: Extreme Technologies, LLC, Vernal, UT (US)

( * ) Notice: Subject to any disclaimer, the term of this patent is extended or adjusted under 35 U.S.C. 154(b) by 90 days.

(21) Appl. No.: 16/286,468

(22) Filed: Feb. 26, 2019

(65) Prior Publication Data

US 2019/0292857 A1 Sep. 26, 2019

Related U.S. Application Data

(63) Continuation of application No. 15/601,326, filed on May 22, 2017, now Pat. No. 10,508,497, which is a (Continued)

(51) Int. Cl.
*E21B 7/28* (2006.01)
*E21B 10/26* (2006.01)
(Continued)

(52) U.S. Cl.
CPC ..... *E21B 7/28* (2013.01); *E21B 10/16* (2013.01); *E21B 10/26* (2013.01); *E21B 10/42* (2013.01)

(58) Field of Classification Search
CPC . E21B 7/28; E21B 10/16; E21B 10/26; E21B 10/42
See application file for complete search history.

(56) References Cited

U.S. PATENT DOCUMENTS 1,489,849 A 4/1924 Sidney et al.
1,772,491 A 8/1930 Koppl
(Continued)

FOREIGN PATENT DOCUMENTS

EP 219959 A1 4/1987
EP 1039095 A1 9/2000
(Continued)

OTHER PUBLICATIONS

Third Party Submission of References tiled in unrelated U.S. App. No. 16/256,690. The submission provides a concise description of the noted references relative to U.S. App. No. 16/256,690, filed Jan. 24, 2020.
(Continued)

*Primary Examiner* — Blake E Michener
(74) *Attorney, Agent, or Firm* — Patent Law Works, LLP; Craig Buschmann

(57) ABSTRACT

An apparatus to increase a diameter of a well bore includes a drill pipe and a first reamer and at least a second reamer. The second reamer is positioned diametrically opposed to the first reamer. A first plurality of cutting teeth are positioned about each of the first reamer and the at least a second reamer. A top of each successive tooth in a direction counter to a rotation of the apparatus in the well bore extends a radial distance from the longitudinal axis. Each tooth of the first plurality of cutting teeth is positioned at a different circumferential location about each reamer from any adjacent teeth of the first plurality of teeth. At least a second plurality of cutting teeth are positioned about each of the first reamer and the at least a second reamer, the at least a second plurality of cutting teeth being spaced longitudinally apart from the first plurality of cutting teeth.

18 Claims, 11 Drawing Sheets

Related U.S. Application Data continuation of application No. 14/454,320, filed on Aug. 7, 2014, now Pat. No. 9,657,526, which is a continuation of application No. 13/517,870, filed on Jun. 14, 2012, now Pat. No. 8,813,877, which is a continuation of application No. 13/441,230, filed on Apr. 6, 2012, now Pat. No. 8,851,205.

(60) Provisional application No. 61/473,587, filed on Apr. 8, 2011.

(51) Int. Cl.
*E21B 10/42* (2006.01)
*E21B 10/16* (2006.01)

(56) References Cited

U.S. PATENT DOCUMENTS

| | | | |
|---|---|---|---|
| 3,231,033 | A | 1/1966 | Williams |
| 3,237,705 | A | 3/1966 | Williams |
| 3,391,749 | A | 7/1968 | Arnold |
| 3,561,549 | A | 2/1971 | Garrison |
| 3,575,247 | A | 4/1971 | Feenstra |
| 3,851,719 | A | 12/1974 | Thompson |
| 3,916,998 | A | 11/1975 | Bass |
| 3,982,594 | A | 9/1976 | Berthiaume |
| 4,080,010 | A | 3/1978 | Young |
| 4,082,373 | A | 4/1978 | Kellner |
| 4,156,374 | A | 5/1979 | Shwayder |
| 4,610,307 | A | 9/1986 | Jurgens |
| 4,729,438 | A | 3/1988 | Walker |
| 4,807,708 | A | 2/1989 | Forrest |
| 4,989,681 | A | 2/1991 | Lohmuller |
| 5,186,265 | A | 2/1993 | Henson |
| 5,372,351 | A | 10/1994 | Oliver |
| 5,495,899 | A | 3/1996 | Pastusek |
| 5,497,842 | A | 3/1996 | Pastusek |
| 5,667,027 | A | 9/1997 | Poffenroth |
| 5,735,359 | A | 4/1998 | Lee |
| 5,765,653 | A | 6/1998 | Doster |
| 5,957,223 | A | 9/1999 | Doster |
| 5,992,548 | A | 11/1999 | Silva |
| 6,039,130 | A | 3/2000 | Pruet |
| RE36,817 | E | 8/2000 | Pastusek |
| 6,109,374 | A | 8/2000 | Burca et al. |
| 6,116,356 | A | 9/2000 | Doster |
| 6,213,226 | B1 | 4/2001 | Eppink et al. |
| 6,227,312 | B1 | 5/2001 | Eppink et al. |
| 6,257,279 | B1 | 7/2001 | Peltz |
| 6,386,302 | B1 | 5/2002 | Beaton |
| 6,397,958 | B1 | 6/2002 | Charles |
| 6,488,104 | B1 | 12/2002 | Eppink |
| 6,494,272 | B1 | 12/2002 | Eppink |
| 6,607,371 | B1 | 8/2003 | Raymond et al. |
| 6,622,803 | B2 | 9/2003 | Harvey |
| 6,695,080 | B2 | 2/2004 | Presley |
| 6,732,817 | B2 | 5/2004 | Dewey |
| 6,920,944 | B2 | 7/2005 | Eppink |
| 6,973,974 | B2 | 12/2005 | McLoughlin |
| 6,991,046 | B2 | 1/2006 | Fielder |
| 7,650,952 | B2 | 1/2010 | Evans |
| 7,901,137 | B1 | 3/2011 | Peterson |
| 8,752,649 | B2 | 6/2014 | Isenhour |
| 8,813,877 | B1 | 8/2014 | Short |
| 8,851,205 | B1 | 10/2014 | Short |
| 9,145,746 | B1 | 9/2015 | Smith |
| 9,163,460 | B2 | 10/2015 | Isenhour |
| 9,273,519 | B2 | 3/2016 | Smith |
| 9,316,056 | B1 | 4/2016 | Isenhour |
| 9,534,448 | B2 | 1/2017 | Da Silva |
| 9,739,092 | B2 | 8/2017 | Isenhour |
| 2001/0045306 | A1 | 11/2001 | Fielder et al. |
| 2002/0020526 | A1 | 2/2002 | Male et al. |
| 2002/0056574 | A1 | 5/2002 | Harvey |
| 2002/0092684 | A1* | 7/2002 | Singh ..... E21B 10/18 175/339 |
| 2002/0125047 | A1 | 9/2002 | Beaton |
| 2002/0166703 | A1 | 11/2002 | Presley |
| 2003/0173114 | A1 | 9/2003 | Presley |
| 2003/0221873 | A1 | 12/2003 | Beaton |
| 2004/0099448 | A1 | 5/2004 | Fielder |
| 2004/0206552 | A1 | 10/2004 | Beaton |
| 2006/0207801 | A1 | 9/2006 | Clayton |
| 2007/0163810 | A1 | 7/2007 | Underwood |
| 2010/0018779 | A1 | 1/2010 | Makkar |
| 2010/0078216 | A1 | 4/2010 | Radford |
| 2010/0089659 | A1 | 4/2010 | Chafai |
| 2010/0116556 | A1 | 5/2010 | Buske |
| 2011/0127044 | A1 | 6/2011 | Radford |
| 2011/0220416 | A1 | 9/2011 | Rives |
| 2012/0057814 | A1 | 3/2012 | Dodson |
| 2012/0255786 | A1 | 10/2012 | Isenhour |
| 2012/0279784 | A1 | 11/2012 | Harvey |
| 2013/0180779 | A1 | 7/2013 | Isenhour |
| 2013/0233620 | A1 | 9/2013 | Rankin |
| 2014/0064646 | A1 | 3/2014 | Meier |
| 2014/0131111 | A1 | 5/2014 | Desmette |
| 2015/0129309 | A1 | 5/2015 | Anderson |
| 2015/0226008 | A1* | 8/2015 | Fladeland ..... E21B 10/28 175/406 |
| 2016/0138342 | A1 | 5/2016 | Svendsen |
| 2017/0241207 | A1 | 8/2017 | Meier |
| 2019/0226285 | A1 | 7/2019 | Teodorescu et al. |

FOREIGN PATENT DOCUMENTS

| | | | |
|---|---|---|---|
| WO | 1994009244 | A1 | 4/1994 |
| WO | 2008026011 | | 3/2008 |
| WO | 2009123918 | | 10/2009 |
| WO | 2014138844 | A1 | 9/2014 |

OTHER PUBLICATIONS

Uyen Partin et al., IADC/SPE 128161—Advanced Modeling Technology: Optimizing Bit-Reamer Interaction Leads to Performance Step-Change in Hole Enlargement While Drilling (IADC/SPE Drilling Conference held New Orleans, LA, Feb. 2-4, 2010)(also available at onepetro.org).

Hal Edwards et al., SPE 158920—Modeling System Improves Salt Drilling Technique with Concentric Reamer/RSS, Deepwater GOM (SPE Annual Technical Conference and Exhibition held San Antonio, TX Oct. 8-10, 2012) (also available at onepetro.org).

International Search Report and Written Opinion dated Dec. 20, 2018 for corresponding PCT/US2018/055230.

PCT Patentability Report for PCT/US13/050205 dated Dec. 23, 2013.

PCT Patentability Report for PCT/US12/58573 dated Jan. 22, 2013.

Schlumberger Oilfield Glossary entry for "borehole", accessed Aug. 12, 2013 via www.glossary.oilfield.slb.com.

Schlumberger Oilfield Glossary entry for "Ream" and "Underreamer", accessed May 22, 2013 via www.glossary.oilfield.slb.com.

PCT/US2012/032714; Search Report in International Patent Application of Isenhour, James; dated Jun. 20, 2012.

Plaintiffs Complaint; *James D. Isenhour, Hard Rock Solutions Inc* vs *Lot William Short, Jr., Short Bit & Tool Co.*, Civil Action No. 11CV1305, Colorado District Court, Larimer County; Oct. 4, 2011.

Plaintiffs First Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Oct. 4, 2011.

Plaintiffs Second Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Jun. 1, 2012.

Defendant's Answer to Plaintiff Second Amended Complaint & Counterclaims; *James D. Isenhour, Hard Rock Solutions Inc.* vs *Lot William Short, Jr., Short Bit & Tool Co.*, Civil Action No. 11CV1305, Colorado District Court, Ladner County; Jun. 15, 2012.

(56) References Cited

OTHER PUBLICATIONS

Short, L.W.; "Bicenter Sub" email; Jun. 19, 2010.
Plaintiff's Reply to Counterclaim and Answer to Cross Claim; *James D. Isenhour, Hard Rock Solutions Inc.* vs *Lot William Short, Jr., Short Bit & Tool Co.*, Civil Action No. 11CV1305, Colorado District Court, Larimer County; Jun. 25, 2012.
Defendant's Initial Disclosures; *James D. Isenhour, Hard Rock Solutions Inc.* vs *Lot William Short, Jr., Short Bit & Tool Co.*, Civil Action No. 11CV1305, Colorado District Court, Larimer County; Jun. 30, 2012.
Plaintiff's Disclosure Statement; *James D. Isenhour, Hard Rock Solutions Inc.* vs *Lot William Short, Jr., Short Bit & Tool Co.*, Civil Action No. 11CV1305, Colorado District Court, Larimer County; Aug. 2, 2012.
Short Bit & Tool Co.; Photograph of TCS Reamer; Apr. 2011.
Short Bit & Tool Co.; Photograph of BCS Tandem and TCS Reamer; Feb. 11, 2011.
Baker Hughes; "RWD2 Ream-While-Drilling"; http://www.bakerhughes.com/products-and-services/drilling/d rill-bit-systems/hole-enlargemenUrwd2-ream-while-drilling; 2012.
OTS International; "TPXR Eccentric Reamers"; http://www.otsintl.com/tpxr.asp; 2012.
OTS International; "TPXR Eccentric Tool for Underreaming Operations"; http://www.otsintl.com/TPXR.pdf; 2012.
Schlumberger; "Diamond-Enhanced Insert Reamer"; http://www.slb.com/services/drilling/tools_services/reamers_stabilizers/diamond_enhanced_reamer.a spx;2012.
National Oilwell VARCO; "Eccentric String Tools (ES)"; http://www.nov.com/Brands/ReedHvcaloq/Eccentric Strinq Tools.aspx; 2012.
Stabil Drill; "Ghost Reamer"; http://www.stabildrill.com/products/ghost_reamer/; 2011.
Schlumberger; "Quad-D Reamer"; http://www.slb.com/services/drilling/tools services/underreamers/quad d reamer.aspx; 2012.
OTS International; "TP Bits"; http://www.otsintl.com/tp.asp; 2012.
OTS International; "TP Series Hyper-Stable PDC Bits"; http://www.otsintl.com/TP-Series-Bits.pdf; 2012.
National Oilwell VARCO; "NOV Downhole—Right Tool, Right Place, Right Time" catalog; http://www.petroleumclub.ro/downloads/07 Tony Watts NOV ReedHycalog.pdf; 2012.
Offshore; "Drilling Operations, Reaming-while-drilling keys effort to reduce tripping of long drillstrings"; http://www.offshore-mag.com/articles/prinUvolume-56/issue-4/departments/drilling-production/drilling-operations-reaming-while-drilling-keys-effort-to-reduce-tripping-of-long-drillstrings.html; 2012.
Varel International; "Hole Opening Bits—Bicenter Technology"; http://www.varelintl.com/Oil and Gas Home/PDC Drill Bits/Hole Opener Bicenter Bits/; 2012.
OMNI Oil Technologies; "Group II—OMNI Versaltile Drilling Reamer/Stabilizer"; http://www.omnioiltech.com/qroup2.php; 2012.
Tercel Oilfield Products; "Versatile Drilling Reamer (VDR)"; http://www.terceloilfield.com/en/drilling-enhancement-vd r. php; 2012.
Sep. 3, 2019 Office Action issued in CN 201810945033.1.
Dictionary definition of "similar", accessed May 22, 2013 via thefreedictionary.com.
PCT Search Report and Written Opinion for PCT App. No. PCT/US18/050208 dated Nov. 8, 2018.
Chinese Office Action dated Jan. 3, 2018 for Appln No. 201280024633.5.
Schlumberger Oilfield Glossary entry for "measurements while drilling" accessed Mar. 25, 2019 via www.glossary.oilfield.slb.com.
International Search Report and Written Opinion dated Nov. 8, 2018 for corresponding PCT/US2018/050208.
Short Bit & Tool Co.; Invoice No. E-279 to Questar E&P; Nov. 1, 2010.
Non-Final Office Action dated Sep. 24, 2020 for U.S. Appl. No. 16/126,394.
European Extended Search Report dated Apr. 9, 2021 for corresponding European Application No. 18865692.0.
U.S. Office Action dated Jan. 4, 2021 for U.S. Appl. No. 16/755,148.
U.S. Office Action dated Sep. 24, 2020 for U.S. Appl. No. 16/126,394.

* cited by examiner

METHOD AND APPARATUS FOR REAMING WELL BORE SURFACES NEARER THE CENTER OF DRIFT

PRIORITY CLAIM

This application is a continuation of U.S. patent application Ser. No. 15/601,326 entitled METHOD AND APPARATUS FOR REAMING WELL BORE SURFACES NEARER THE CENTER OF DRIFT, filed May 22, 2017, which in turn is a continuation of U.S. patent application Ser. No. 14/454,320 entitled METHOD AND APPARATUS FOR REAMING WELL BORE SURFACES NEARER THE CENTER OF DRIFT, filed Aug. 7, 2014 and which issued as U.S. Pat. No. 9,657,526 on May 23, 2017, which in turn is a continuation of U.S. patent application Ser. No. 13/517,870 entitled METHOD AND APPARATUS FOR REAMING WELL BORE SURFACES NEARER THE CENTER OF DRIFT, filed Jun. 14, 2012 and which issued as U.S. Pat. No. 8,813,877 on Aug. 26, 2014, which in turn is a continuation of U.S. patent application Ser. No. 13/441,230 entitled METHOD AND APPARATUS FOR REAMING WELL BORE SURFACES NEARER THE CENTER OF DRIFT, filed Apr. 6, 2012 and which issued as U.S. Pat. No. 8,851,205 on Oct. 7, 2014, which in turn claims priority to and the benefit of the filing date of U.S. Provisional Patent Application Ser. No. 61/473,587 entitled METHOD AND APPARATUS FOR REAMING WELL BORE SURFACES NEARER THE CENTER OF DRIFT, filed Apr. 8, 2011, all of which are specifically and entirely incorporated by reference.

TECHNICAL FIELD

The present invention relates to methods and apparatus for drilling wells and, more particularly, to a reamer and corresponding method for enlarging the drift diameter and improving the well path of a well bore.

BACKGROUND

Extended reach wells are drilled with a bit driven by a down hole motor that can be steered up, down, left, and right. Steering is facilitated by a bend placed in the motor housing above the drill bit. Holding the drill string in the same rotational position, such as by locking the drill string against rotation, causes the bend to consistently face the same direction. This is called "sliding". Sliding causes the drill bit to bore along a curved path, in the direction of the bend, with the drill string following that path as well.

Repeated correcting of the direction of the drill bit during sliding causes friction between the well bore and the drill string greater than when the drill string is rotated. Such corrections form curves in the well path known as "dog-legs". Referring to FIG. 1*a*, the drill string 10 presses against the inside of each dogleg turn 12, causing added friction. These conditions can limit the distance the well bore 14 can be extended within the production zone, and can also cause problems getting the production string through the well bore.

Similar difficulties can also occur during conventional drilling, with a conventional drill bit that is rotated by rotating the drill string from the surface. Instability of the drill bit can cause a spiral or other tortuous path to be cut by the drill bit. This causes the drill string to press against the inner surface of resulting curves in the well bore and can interfere with extending the well bore within the production zone and getting the production string through the well bore.

When a dogleg, spiral path or tortuous path is cut by a drill bit, the relatively unobstructed passageway following the center of the well bore has a substantially smaller diameter than the well bore itself. This relatively unobstructed passageway is sometimes referred to as the "drift" and the nominal diameter of the passageway is sometimes referred to as the "drift diameter". The "drift" of a passageway is generally formed by well bore surfaces forming the inside radii of curves along the path of the well bore. Passage of pipe or tools through the relatively unobstructed drift of the well bore is sometimes referred to as "drift" or "drifting".

In general, to address these difficulties the drift diameter has been enlarged with conventional reaming techniques by enlarging the diameter 16 of the entire well bore. See FIG. 1*a*. Such reaming has been completed as an additional step, after drilling is completed. Doing so has been necessary to avoid unacceptable increases in torque and drag during drilling. Such additional reaming runs add considerable expense and time to completion of the well. Moreover, conventional reaming techniques frequently do not straighten the well path, but instead simply enlarge the diameter of the well bore.

Accordingly, a need exists for a reamer that reduces the torque required and drag associated with reaming the well bore.

A need also exists for a reamer capable of enlarging the diameter of the well bore drift passageway and improving the well path, without needing to enlarge the diameter of the entire well bore.

SUMMARY

To address these needs, the invention provides a method and apparatus for increasing the drift diameter and improving the well path of the well bore. This is accomplished, in one embodiment, by cutting away material primarily forming surfaces nearer the center of the drift. Doing so reduces applied power, applied torque and resulting drag compared to conventional reamers that cut into all surfaces of the well bore.

An apparatus is configured to be positioned in at least one of a drill string and a bottom hole assembly and adapted to increasing a diameter of a well bore. The apparatus includes a drill pipe that includes a first end, a second end spaced apart from the first end, and a longitudinal axis that is aligned with a longitudinal axis of at least one of the drill string and the bottom hole assembly. A first reamer and at least a second reamer are coupled to the drill pipe, wherein the second reamer is spaced longitudinally apart from the first reamer, and wherein the second reamer is positioned diametrically opposed to the first reamer on the drill pipe. A first plurality of cutting teeth are positioned about each of the first reamer and the at least a second reamer, wherein a top of each successive tooth in a direction counter to a rotation of the apparatus in the well bore extends a radial distance from the longitudinal axis that is one of a) equal to a radial distance from the longitudinal axis of a preceding tooth and b) greater than the radial distance from the longitudinal axis of the preceding tooth. Each tooth of the first plurality of cutting teeth is positioned at a different circumferential location about each reamer from any adjacent teeth of the first plurality of teeth. At least a second plurality of cutting teeth are positioned about each of the first reamer and the at least a second reamer, the at least a second plurality of cutting teeth being spaced longitudinally apart from the first plurality of cutting teeth.

The at least a second plurality of cutting teeth optionally includes a top of each successive tooth in a direction counter to a rotation of the apparatus in the well bore that extends a radial distance from the longitudinal axis that is one of a) equal to a radial distance from the longitudinal axis of a preceding tooth and b) greater than the radial distance from the longitudinal axis of the preceding tooth. Optionally, each tooth of the second plurality of cutting teeth is positioned at a different circumferential location about each reamer from any adjacent teeth of the at least a second plurality of teeth.

At least one of the first reamer and the at least a second reamer optionally may include at least one groove formed in a surface of the first reamer and the at least a second reamer. A long axis of the groove, when viewed in profile, may intersect at an acute angle the longitudinal axis of the drill pipe as the longitudinal axis extends downhole. An uphole portion of the at least one groove may be spaced longitudinally apart and may be at substantially a same circumferential position as a downhole portion of at least a second groove formed in the surface of at least one of the first reamer and the at least a second reamer.

Optionally, the first plurality of cutting teeth and the at least a second plurality of cutting teeth, in combination, define a plurality of sets of teeth, and wherein each set defines a blade. A center of each tooth of a first set of teeth of the plurality of sets of teeth may be longitudinally spaced apart and positioned at a different circumferential location from a center of each tooth of an adjacent set of teeth of the plurality of sets of teeth. The at least one groove optionally separates a first set of teeth of the plurality of sets of teeth from at least a second set of teeth of the plurality of sets of teeth. A width of the at least one groove may be greater than a width of at least one blade defined by a set of the plurality of sets of teeth.

Optionally, each successive tooth of the first plurality of teeth is positioned at one a) the same longitudinal position as the preceding tooth and b) longitudinally spaced apart from the preceding tooth by a distance measured from a center of the preceding tooth that is less than a radius of the preceding tooth.

Optionally, at least a first tooth of the at least a second plurality of teeth is spaced longitudinally apart from at least a first tooth of the first plurality of teeth by a distance measured from a center of the at least a first tooth of the first plurality of teeth that is one of a) equal to and b) greater than a radius of the at least a first tooth of the first plurality of teeth. The at least the first tooth of the at least a second plurality of teeth may be spaced longitudinally apart from at least a second tooth of the first plurality of teeth by a distance measured from a center of the at least a second tooth of the first plurality of teeth that is one of a) equal to and b) greater than a radius of the at least a second tooth of the first plurality of teeth.

A center of at least a first tooth of the at least a second plurality of teeth may be spaced at a different circumferential location than a center of at least a first tooth of the first plurality of teeth.

A first plane may extend through a center of each tooth of the first plurality of teeth, when viewed in profile, and intersect at an acute angle the longitudinal axis of the drill pipe as the longitudinal axis extends downhole.

Optionally, at least the first plurality of cutting elements covers approximately fifty percent of the circumference of at least one of the first reamer and the at least a second reamer. The at least the first plurality of cutting elements also may be arranged along a spiral path along a surface of at least one of the first reamer and the at least a second reamer.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

Figure 1A:
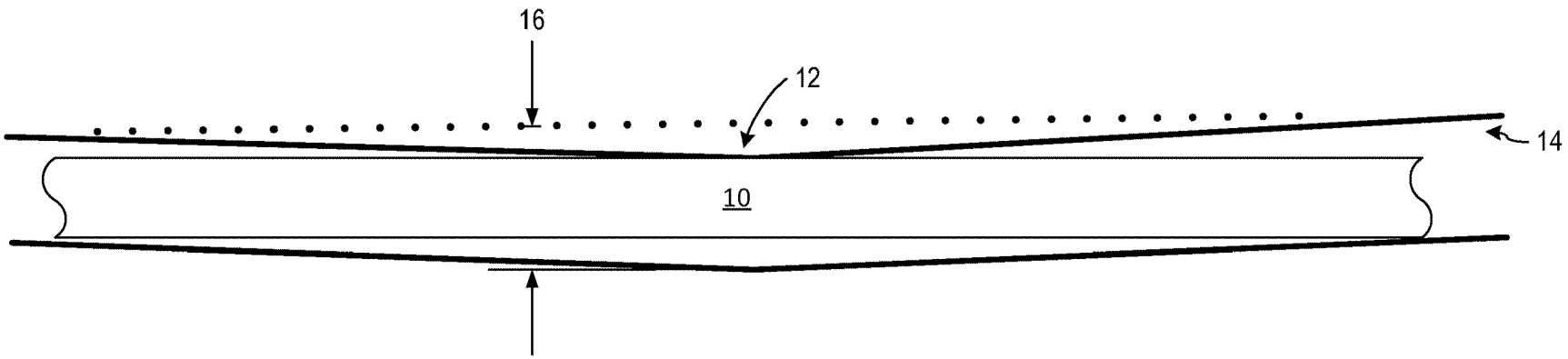
FIGS. 1*a* and 1*b* are a cross-section elevations of a horizontal well bore.

The drawings are not necessarily to scale.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, specific details, and the like have been omitted inasmuch as such details are not considered necessary to obtain a complete understanding of the present invention, and are considered to be within the understanding of persons of ordinary skill in the relevant art.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

The terms "up" and "down"; "upper" and "lower"; "upward" and downward"; "above" and "below"; and other like terms as used herein refer to relative positions to one another and are not intended to denote a particular direction or spatial orientation or perspective view FIG. 1*b* is a cross-section elevation of a horizontal well bore 100, illustrating an embodiment of the invention employing a top eccentric reamer 102 and a bottom eccentric reamer 104. The top reamer 102 and bottom reamer 104 are preferably of a similar construction and may be angularly displaced by approximately 180° on a drill string 106. This causes cutting teeth 108 of the top reamer 102 and cutting teeth 110 of the bottom reamer 104 to face approximately opposite directions. The reamers 102 and 104 may be spaced apart and positioned to run behind a bottom hole assembly (BHA). In one embodiment, for example, the eccentric reamers 102 and 104 may be positioned within a range of approximately 100 to 150 feet from the BHA. Although two reamers are shown, a single reamer or a larger number of reamers could be used in the alternative.

Figure 3:
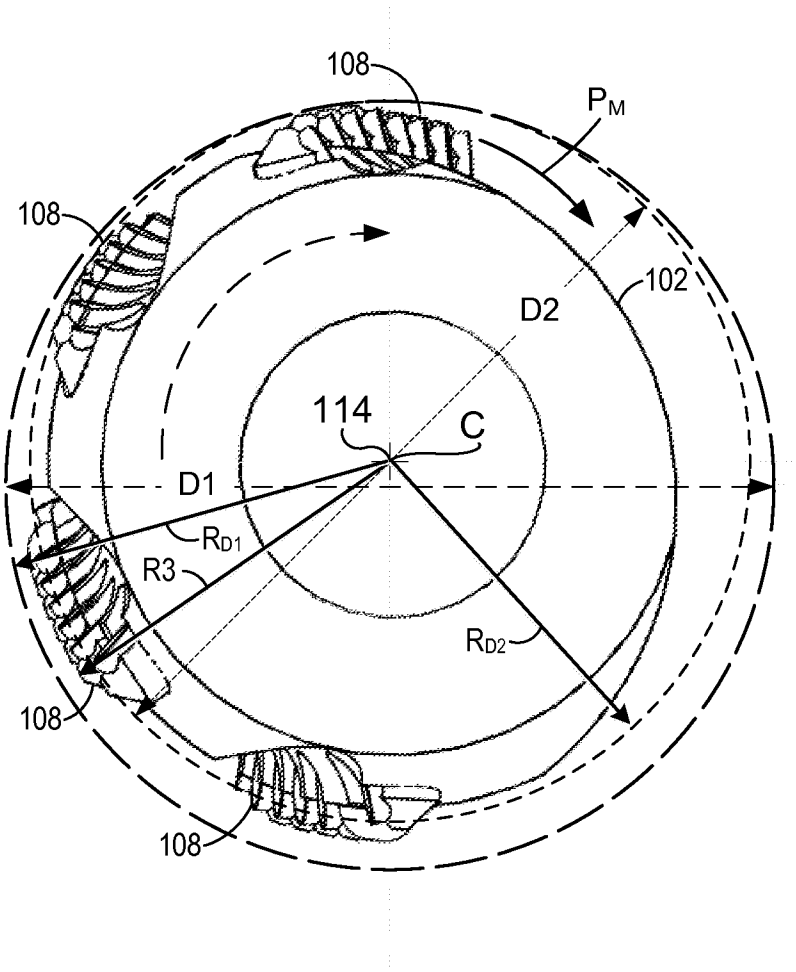
FIG. 3 is a representation an eccentric reamer in relation to the well bore shown in FIG. 2.

As shown in FIG. 1*b*, the drill string 106 advances to the left as the well is drilled. As shown in FIG. 2, the well bore 100 may have a drill diameter D1 of 6 inches and a drill center 116. The well bore 100 may have a drift diameter D2 of 5⅝ inches and a drift center 114. The drift center 114 may be offset from the drill center 116 by a fraction of an inch. Any point P on the inner surface 112 of the well bore 100 may be located at a certain radius R1 from the drill center 116 and may also be located at a certain radius R2 from the drift center 114. As shown in FIG. 3, in which reamer 102 is shown having a threaded center C superimposed over drift center 114, each of the reamers 102 (shown) and 104 (not shown) preferably has an outermost radius R3, generally in the area of its teeth 108, less than the outermost radius RD1 of the well bore. However, the outermost radius R3 of each reamer is preferably greater than the distance RD2 of the nearer surfaces from the center of drift 114. The cutting surfaces of each of the top and bottom reamers preferably comprise a number of carbide or diamond teeth 108, with each tooth preferably having a circular cutting surface generally facing the path of movement PM of the tooth relative to the well bore as the reamer rotates and the drill string advances down hole.

In FIG. 1*b*, the bottom reamer 104 begins to engage and cut a surface nearer the center of drift off the well bore 100 shown. As will be appreciated, the bottom reamer 104, when rotated, cuts away portions of the nearer surface 112A of the well bore 100, while cutting substantially less or none of the surface 112B farther from the center of drift, generally on the opposite side of the well. The top reamer 102 performs a similar function, cutting surfaces nearer the center of drift as the drill string advances. Each reamer 102 and 104 is preferably spaced from the BHA and any other reamer to allow the centerline of the pipe string adjacent the reamer to be offset from the center of the well bore toward the center of drift or aligned with the center of drift.

Figure 4:
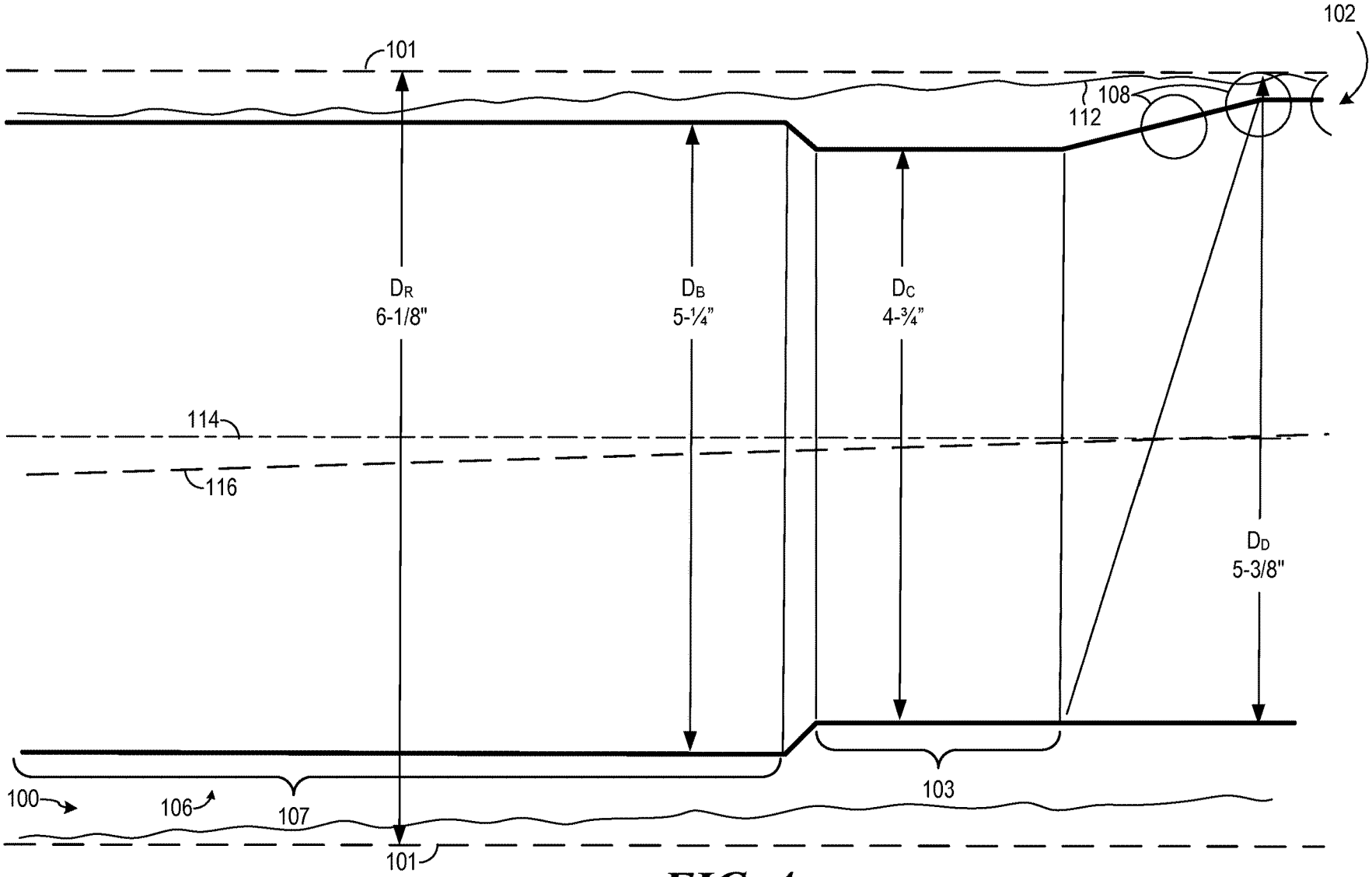
FIG. 4 is a magnification of the downhole portion of the top reamer.

FIG. 4 is a magnification of the downhole portion of the top reamer 102 as the reamer advances to begin contact with a surface 112 of the well bore 100 nearer the center of drift 114. As the reamer 102 advances and rotates, the existing hole is widened along the surface 112 nearer the center of drift 114, thereby widening the drift diameter of the hole. In an embodiment, a body portion 107 of the drill string 106 may have a diameter DB of 5¼ inches, and may be coupled to a cylindrical portion 103 of reamer 102, the cylindrical portion 103 having a diameter DC of approx. 4¾ inches. In an embodiment, the reamer 102 may have a "DRIFT" diameter DD of 5⅜ inches, and produce a reamed hole having a diameter DR of 6⅛ inches between reamed surfaces 101. It will be appreciated that the drill string 106 and reamer 102 advance through the well bore 100 along a path generally following the center of drift 114 and displaced from the center 116 of the existing hole.

Figure 1B:
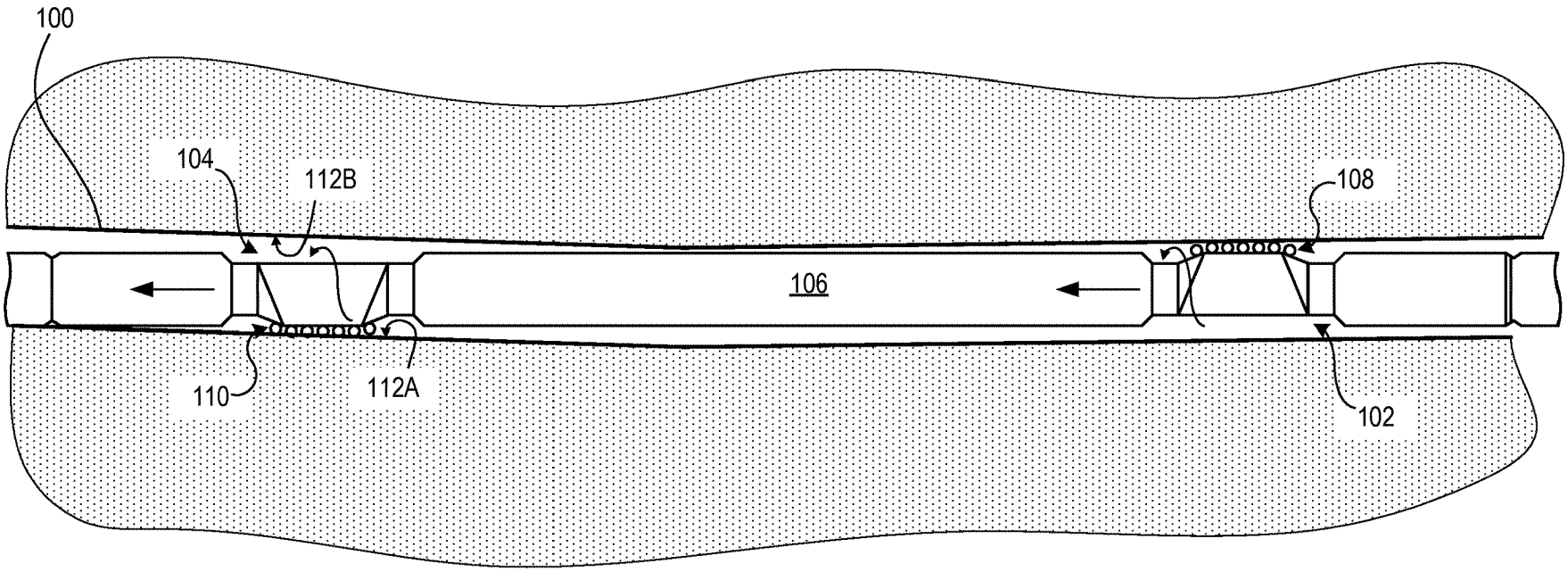
Figure 2:
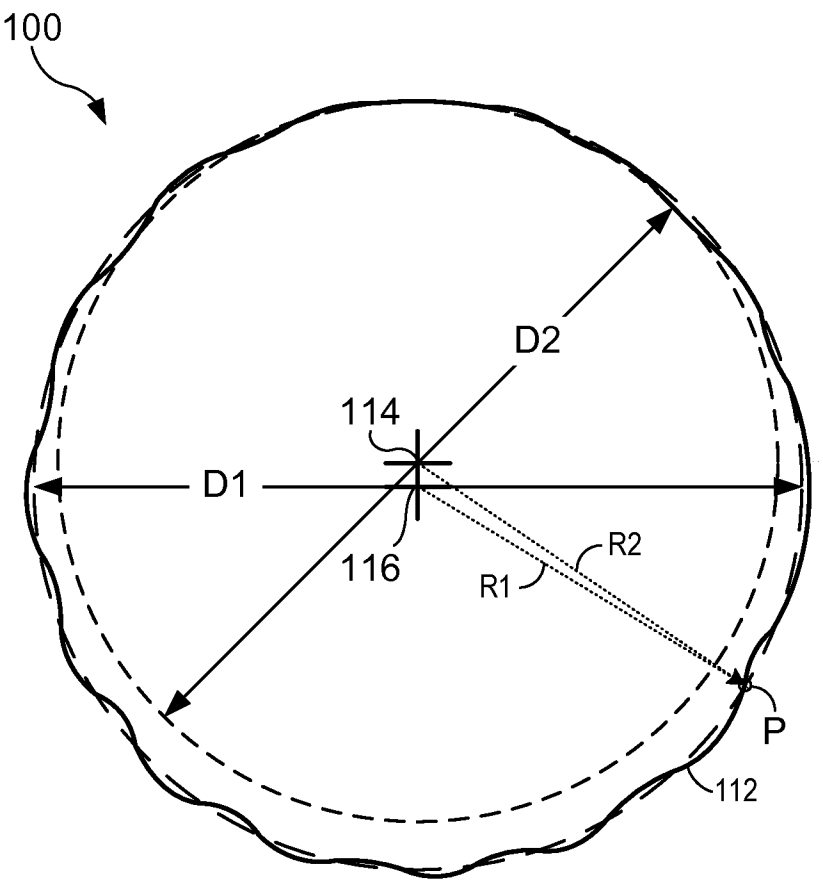
FIG. 2 is a representation of a well bore illustrating drift diameter relative to drill diameter.
Figure 5:
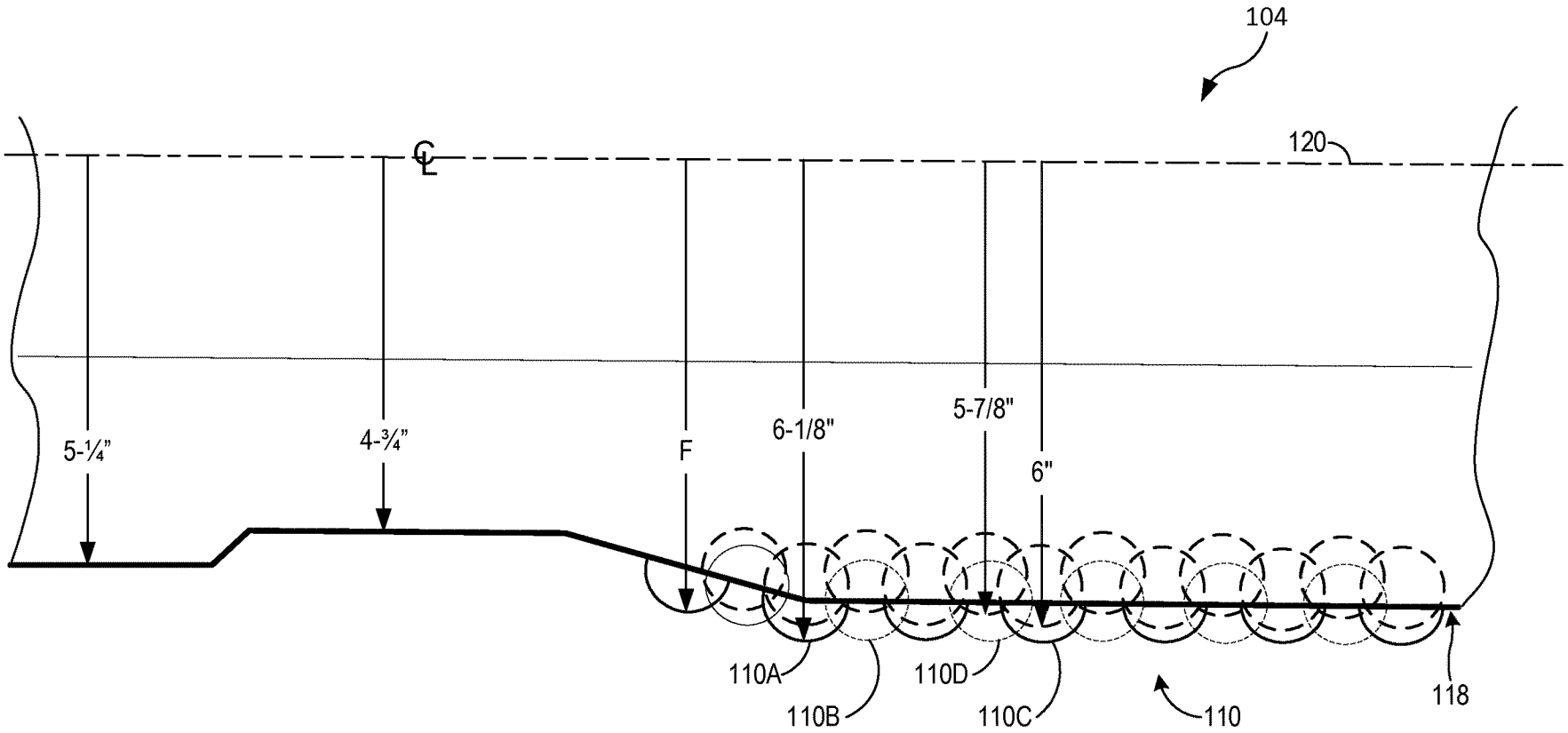
FIG. 5 is illustrates the layout of teeth along a downhole portion of the bottom reamer illustrated in FIG. 1.

FIG. 5 illustrates the layout of teeth 110 along a downhole portion of the bottom reamer 104 illustrated in FIG. 1. Four sets of teeth 110, Sets 110A, 110B, 110C and 110D, are angularly separated about the exterior of the bottom reamer 104. FIG. 5 shows the position of the teeth 110 of each Set as they pass the bottom-most position shown in FIG. 1*b* when the bottom reamer 104 rotates. As the reamer 104 rotates, Sets 110A, 110B, 110C and 110D 110A, 110B, 110C and 110D pass the bottom-most position in succession. The Sets 110A, 110B, 110C and 110D of teeth 110 are arranged on a substantially circular surface 118 having a center 120 eccentrically displaced from the center of rotation of the drill string 106.

Figure 6:
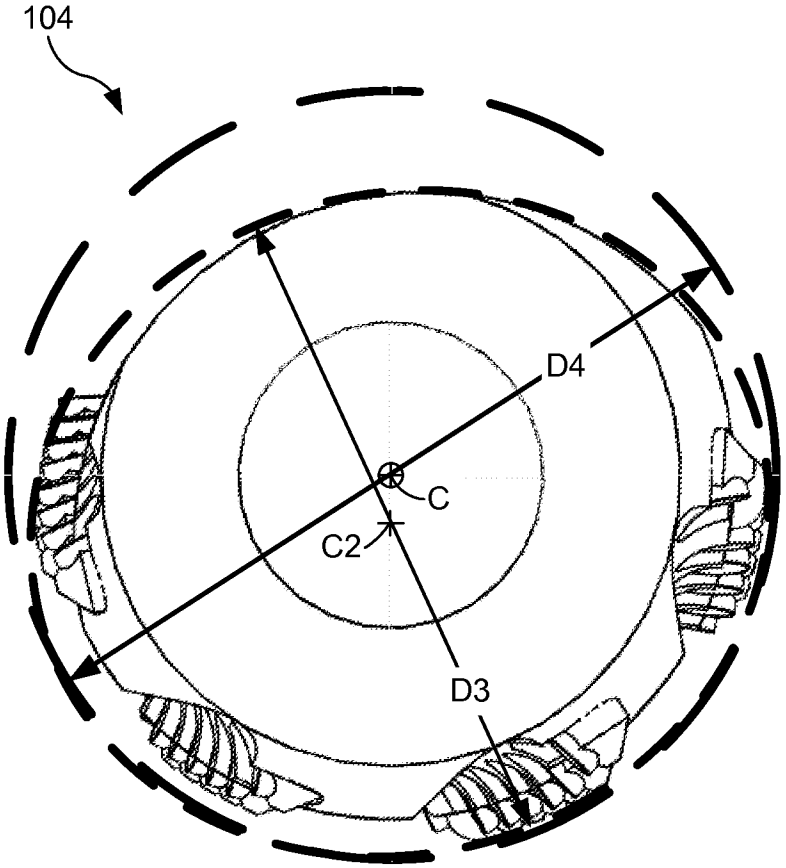
FIG. 6 is an end view of an eccentric reamer illustrating the eccentricity of the reamer in relation to a well bore diameter.

Each of the Sets 110A, 110B, 110C and 110D of teeth 110 is preferably arranged along a spiral path along the surface of the bottom reamer 104, with the downhole tooth leading as the reamer 104 rotates (e.g., see FIG. 6). Sets 110A and 110B of the reamer teeth 110 are positioned to have outermost cutting surfaces forming a 6⅛ inch diameter path when the pipe string 106 is rotated. The teeth 110 of Set 110B are preferably positioned to be rotated through the bottom-most point of the bottom reamer 104 between the rotational path of the teeth 110 of Set 110A. The teeth 110 of Set 110C are positioned to have outermost cutting surfaces forming a six inch diameter when rotated, and are preferably positioned to be rotated through the bottom-most point of the bottom reamer between the rotational path of the teeth 110 of Set 110B. The teeth 110 of Set 110D are positioned to have outermost cutting surfaces forming a 5⅞ inch diameter when rotated, and are preferably positioned to be rotated through the bottom-most point of the bottom reamer 104 between the rotational path of the teeth 110 of Set 110C.

FIG. 6 illustrates one eccentric reamer 104 having a drift diameter D3 of 5⅝ inches and a drill diameter D4 of 6 1/16 inches. When rotated about the threaded axis C, but without a concentric guide or pilot, the eccentric reamer 104 may be free to rotate about its drift axis C2 and may act to side-ream the near-center portion of the dogleg in the borehole. The side-reaming action may improve the path of the wellbore instead of just opening it up to a larger diameter.

Figure 7:
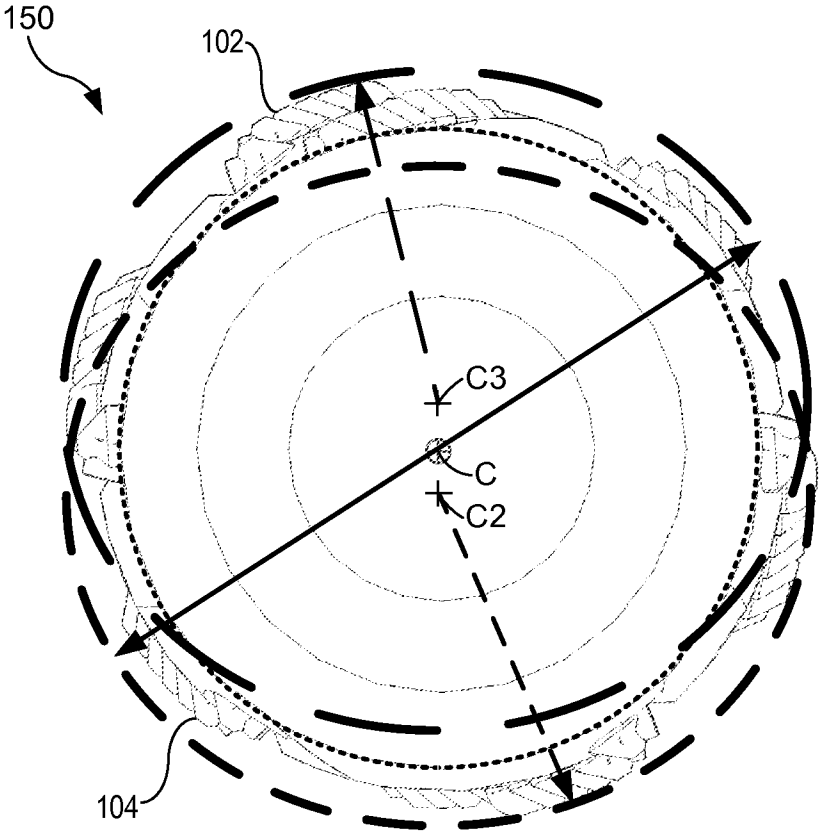
FIG. 7 is an end view of two eccentric reamers in series, illustrating the eccentricity of the two reamers in relation to a well bore diameter.

FIG. 7 illustrates a reaming tool 150 having two eccentric reamers 104 and 102, each eccentric reamer having a drift diameter D3 of 5⅝ inches and a drill diameter D4 of 6 1/16 inches. The two eccentric reamers may be spaced apart by ten hole diameters or more, on a single body, and synchronized to be 180 degrees apart relative to the threaded axis of the body. The reaming tool 150 having two eccentric reamers configured in this way, may be able to drift through a 5⅝ inch hole when sliding and, when rotating, one eccentric reamer may force the other eccentric reamer into the hole wall. An eccentric reaming tool 150 in this configuration has three centers: the threaded center C coincident with the threaded axis of the reaming toll 150, and two eccentric centers C2, coincident with the drift axis of the bottom eccentric reamer 104, and C3, coincident with a drift axis of the top eccentric reamer 102.

Figure 8:
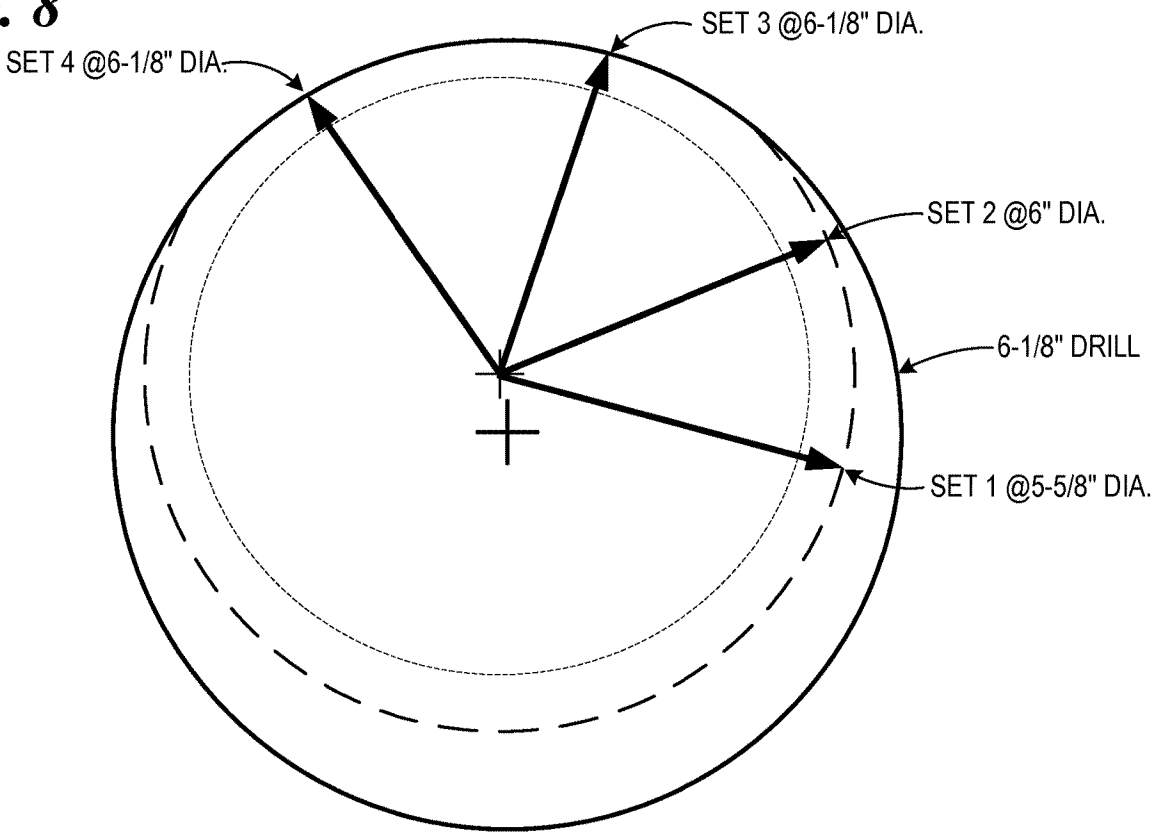
FIG. 8 illustrates the location and arrangement of Sets 1, 2, 3 and 4 of teeth on another reamer embodiment.
Figure 9:
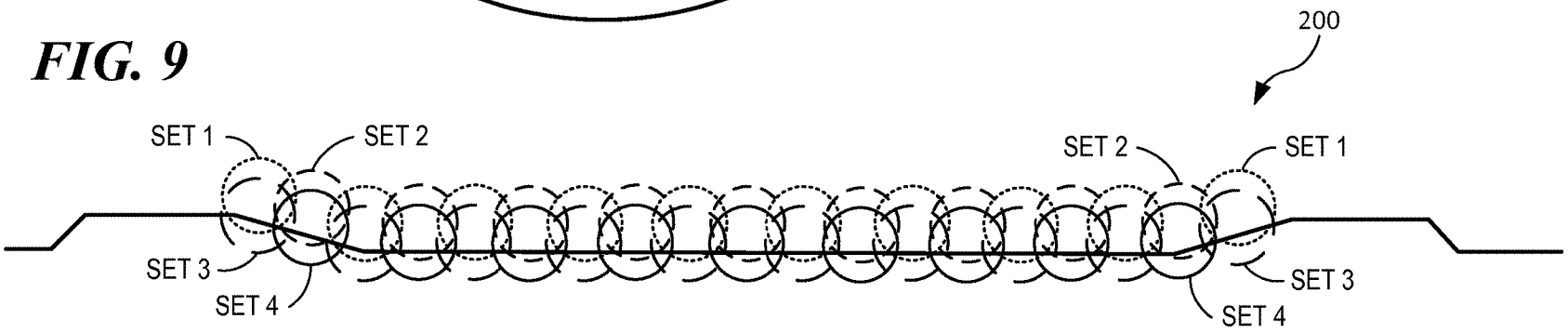
FIG. 9 illustrates the location and arrangement of Sets 1, 2, 3 and 4 of teeth on another reamer embodiment.

FIGS. 8 and 9 illustrate the location and arrangement of Sets 1, 2, 3 and 4 of teeth on another reamer embodiment 200. FIG. 8 illustrates the relative angles and cutting diameters of Sets 1, 2, 3, and 4 of teeth. As shown in FIG. 8, Sets 1, 2, 3 and 4 of teeth are each arranged to form a path of rotation having respective diameters of 5⅝ inches, 6 inches, 6⅛ inches and 6⅛ inches. FIG. 9 illustrates the relative position of the individual teeth of each of Sets 1, 2, 3 and 4 of teeth. As shown in FIG. 9, the teeth of Set 2 are preferably positioned to be rotated through the bottom-most point of the reamer between the rotational path of the teeth of Set 1. The teeth of Set 3 are preferably positioned to be rotated through the bottom-most point of the reamer between the rotational path of the teeth of Set 2. The teeth of Set 4 are preferably positioned to be rotated through the bottom-most point of the reamer between the rotational path of the teeth of Set 3.

Figure 10:
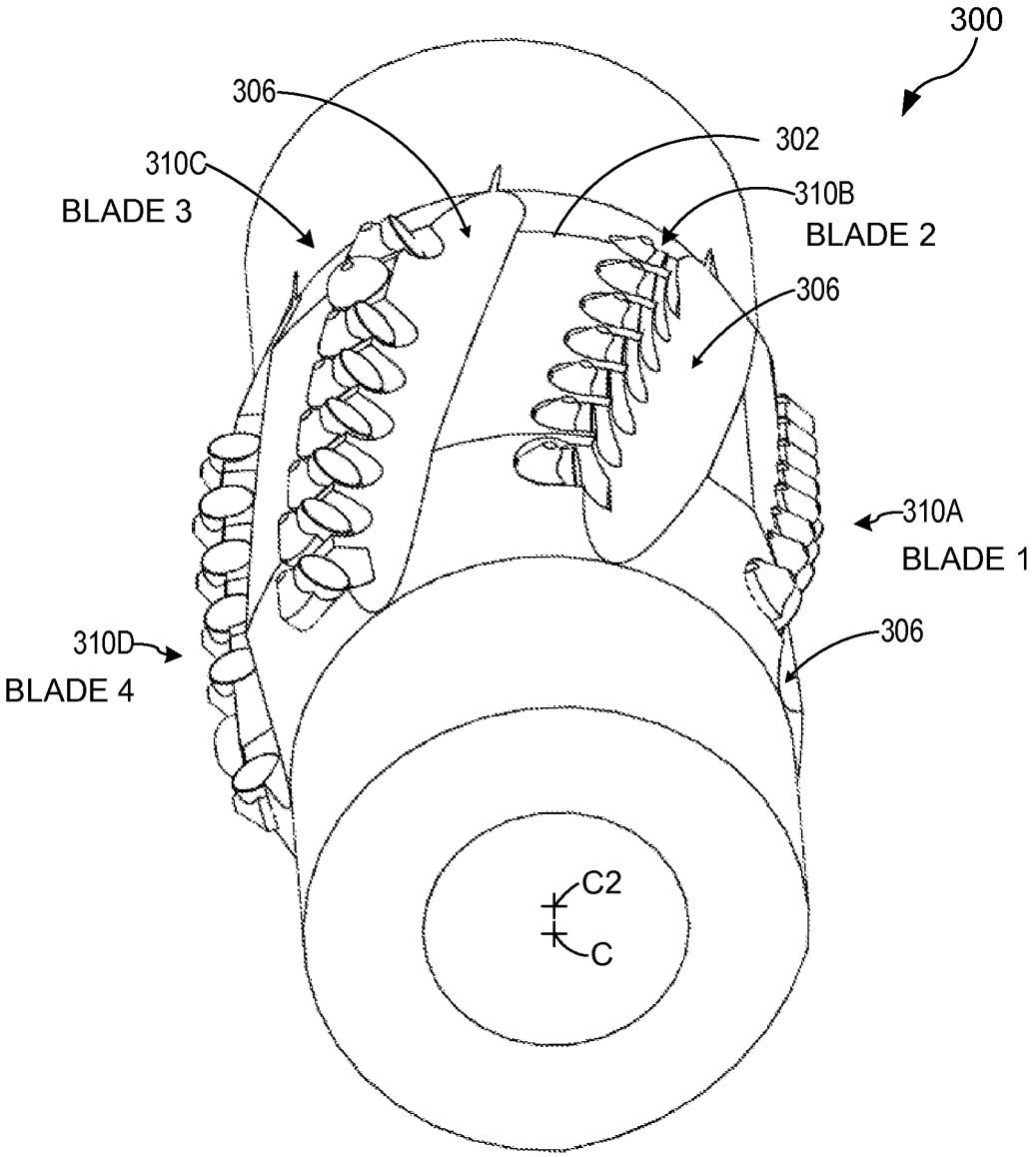
FIG. 10 is a perspective view illustrating an embodiment of a reamer having four sets of teeth.

FIG. 10 illustrates an embodiment of a reamer 300 having four sets of teeth 310, with each set 310A, 310B, 310C, and 310D arranged in a spiral orientation along a curved surface 302 having a center C2 eccentric with respect to the center C of the drill pipe on which the reamer is mounted. Adjacent and in front of each set of teeth 310 is a groove 306 formed in the surface 302 of the reamer. The grooves 306 allow fluids, such as drilling mud for example, and cuttings to flow past the reamer and away from the reamer teeth during operation. The teeth 310 of each set 310A, 310B, 310C, and 310D may form one of four "blades" for cutting away material from a near surface of a well bore. The set 310A may form a first blade, or Blade 1. The set 310B may form a second blade, Blade 2. The set 310C may form a third blade, Blade 3. The set 310D may form a fourth blade, Blade 4. The configuration of the blades and the cutting teeth thereof may be rearranged as desired to suit particular applications, but may be arranged as follows in an exemplary embodiment.

Figure 11:
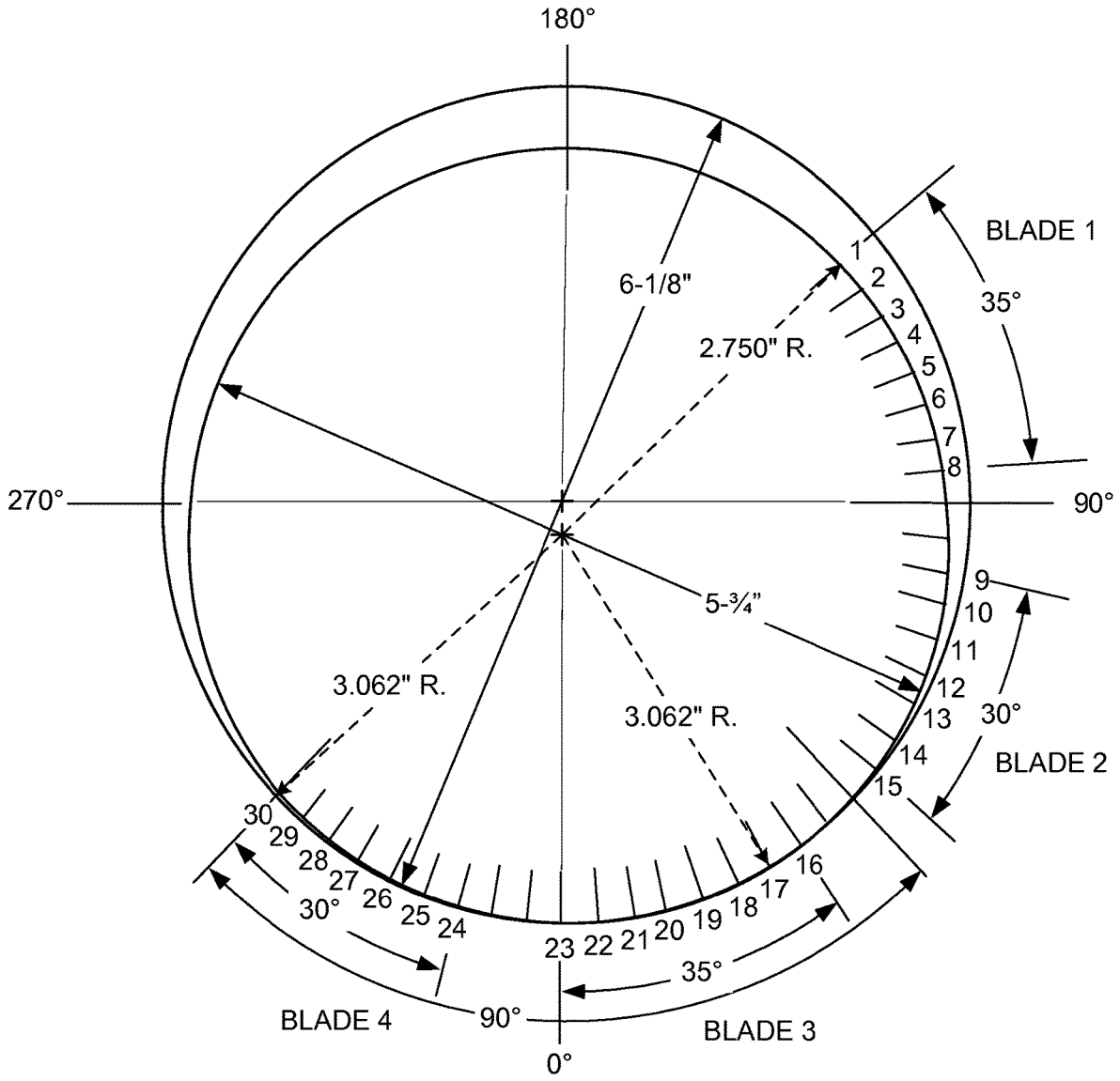
FIG. 11 is a geometric diagram illustrating the arrangement of cutting teeth on an embodiment of a reamer.
Figures 12A, 12B, 12C, 12D:
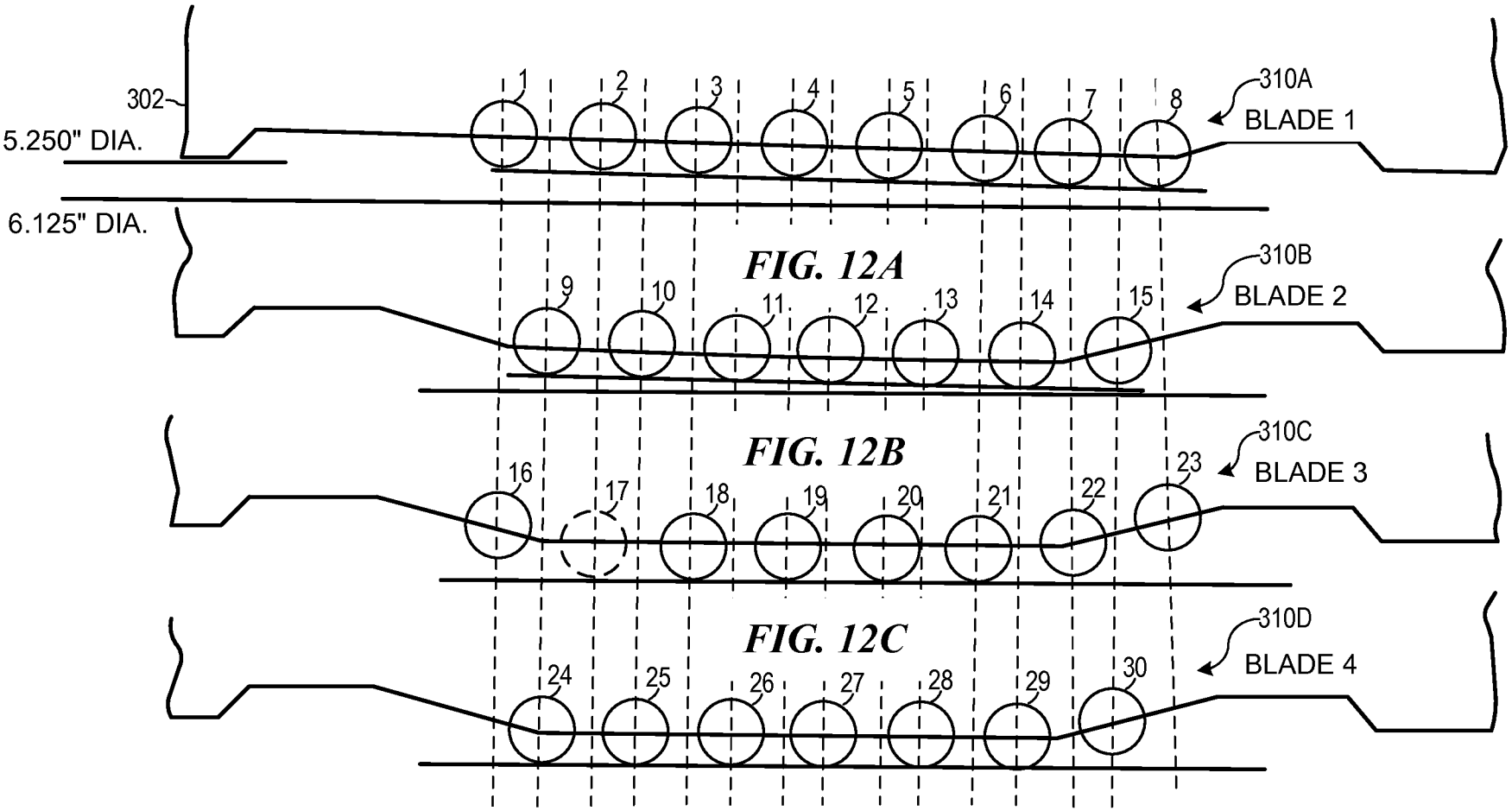
FIG. 12A-12D illustrate the location and arrangement of Blades 1, 2, 3, and 4 of cutting teeth.

Turning now to FIG. 11, the tops of the teeth 310 in each of the two eccentric reamers 300, or the reamers 102 and 104, rotate about the threaded center of the reamer tool and may be placed at increasing radii starting with the #1 tooth at 2.750" R. The radii of the teeth may increase by 0.018" every five degrees through tooth #17 where the radii become constant at the maximum of 3.062", which corresponds to the 6⅛" maximum diameter of the reamer tool.

Turning now to FIGS. 12A-12D, the reamer tool may be designed to side-ream the near side of a directionally near horizontal well bore that is crooked in order to straighten out the crooks. As shown in FIG. 12A-12D, 30 cutting teeth numbered 1 through 30 may be distributed among Sets 310A, 310B, 310C, and 310D of cutting teeth forming four blades. As plotted in FIG. 11, the cutting teeth numbered 1 through 8 may form Blade 1, the cutting teeth numbered 9 through 15 may form Blade 2, the cutting teeth numbered 16 through 23 may form Blade 3, and the cutting teeth numbered 24 through 30 may form Blade 4. As the 5¼" body 302 of the reamer is pulled into the near side of the crook, the cut of the rotating reamer 300 may be forced to rotate about the threaded center of the body and cut an increasingly larger radius into just the near side of the crook without cutting the opposite side. This cutting action may act to straighten the crooked hole without following the original bore path.

Figure 13:
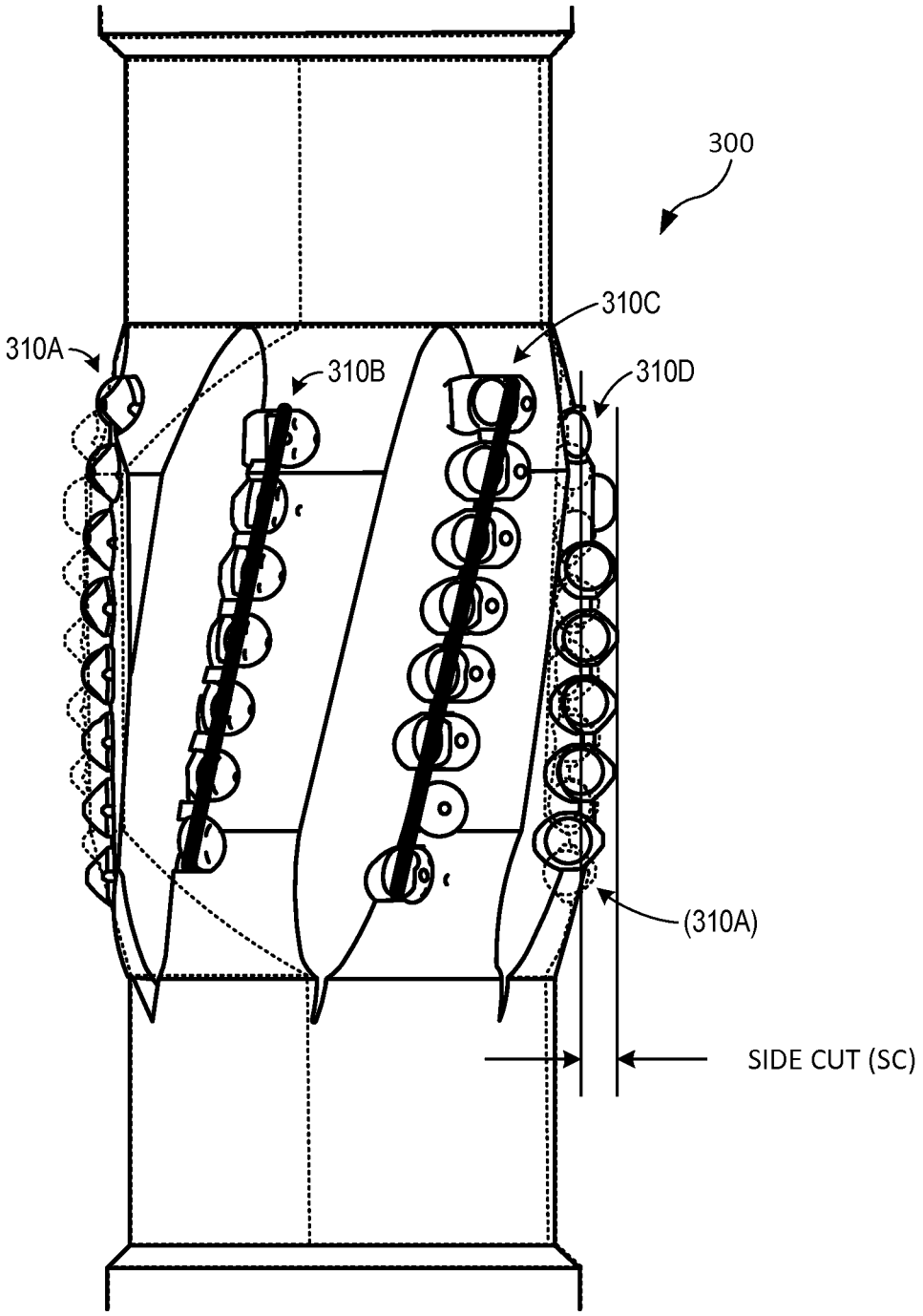
FIG. 13 is a side view of a reamer tool showing the cutting teeth and illustrating a side cut area.

Turning now to FIG. 13, the reamer 300 is shown with the teeth 310A of Blade 1 on the left-hand side of the reamer 300 as shown, with the teeth 310B of Blade 2 following behind to the right of Blade1, the teeth 310C of Blade 3 following behind and to the right of Blade 2, and the teeth 310D of Blade 4 following behind and to the right of Blade 3. The teeth 310A of Blade 1 are also shown in phantom, representing the position of teeth 310A of Blade 1 compared to the position of teeth 310D of Blade 4 on the right-hand side of the reamer 300, and at a position representing the "Side Cut" made by the eccentric reamer 300.

Figure 14D:
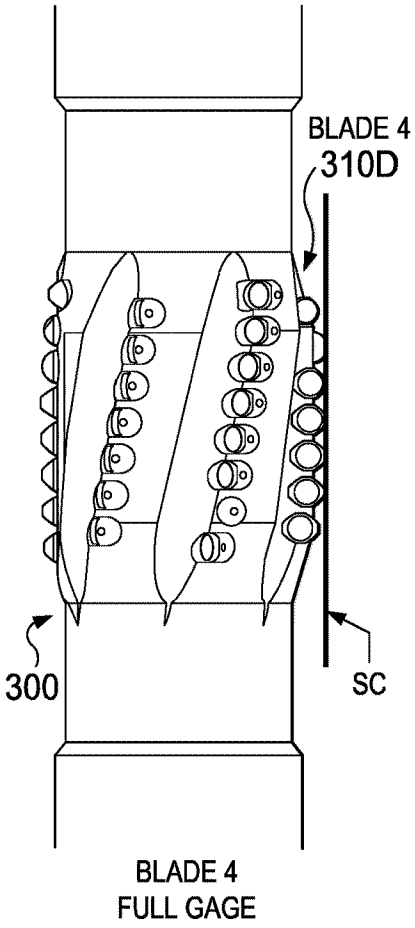
FIGS. 14A-14D are side views of a reamer tool showing the cutting teeth and illustrating a sequence of Blades 1, 2, 3, and 4 coming into the side cut area and the reamer tool rotates.
Figure 14C:
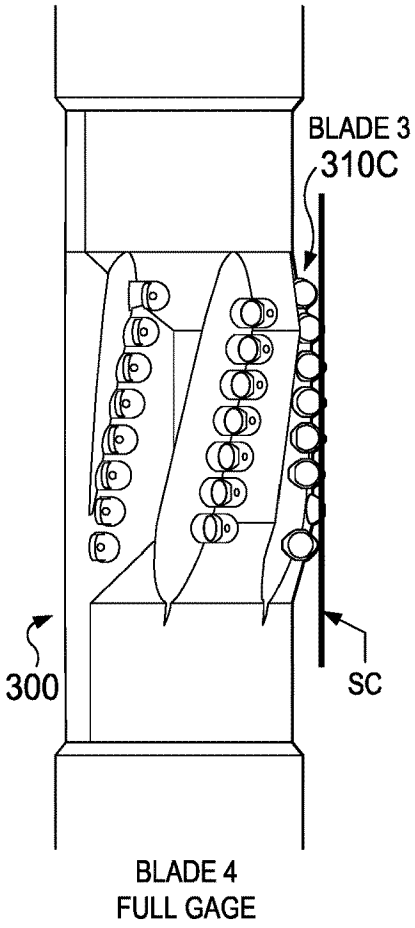
Figure 14B:
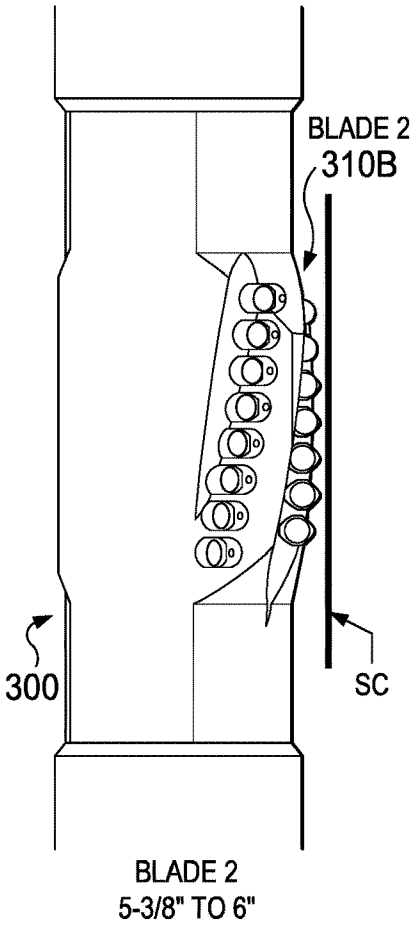
Figure 14A:
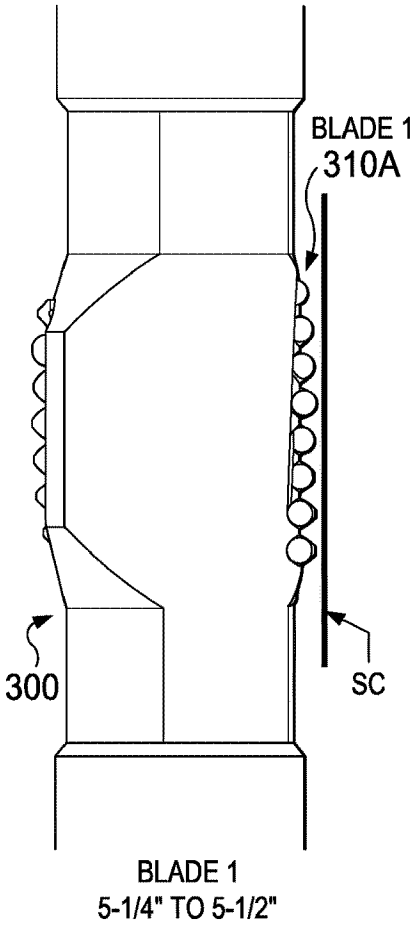

Turning now to FIGS. 14A-14D, the extent of each of Blade 1, Blade 2, Blade 3, and Blade 4 is shown in a separate figure. In each of the FIG. 14A-14D, the reamer 300 is shown rotated to a different position, bringing a different blade into the "Side Cut" position SC, such that the sequence of views 14A-14D illustrate the sequence of blades coming into cutting contact with a near surface of a well bore. In FIG. 14A, Blade 1 is shown to cut from a 5¼" diameter to a 5½" diameter, but less than a full-gage cut. In FIG. 14B, Blade 2 is shown to cut from a 5⅜" diameter to a 6" diameter, which is still less than a full-gage cut. In FIG. 14C, Blade 3 is shown to cut a "Full Gage" diameter, which may be equal to 6⅛" in an embodiment. In FIG. 14D, Blade 4 is shown to cut a "Full gage" diameter, which may be equal to 6⅛" in an embodiment.

The location and arrangement of Sets of teeth on an embodiment of an eccentric reamer as described above, and teeth within each set, may be rearranged to suit particular applications. For example, the alignment of the Sets of teeth relative to the centerline of the drill pipe, the distance between teeth and Sets of teeth, the diameter of rotational path of the teeth, number of teeth and Sets of teeth, shape and eccentricity of the reamer surface holding the teeth and the like may be varied.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. All such similar substitutes and modifications apparent to those skilled in the art are deemed to be within the spirit, scope and concept of the disclosure as defined by the appended claims.

The invention claimed is:

1. An apparatus configured to be positioned in at least one of a drill string and a bottom hole assembly and adapted to increasing a diameter of a well bore, comprising:

a drill pipe that includes a first end, a second end spaced apart from the first end, and a longitudinal axis that is aligned with a longitudinal axis of at least one of the drill string and the bottom hole assembly;

a first eccentric reamer and at least a second eccentric reamer coupled to the drill pipe, wherein the second eccentric reamer is spaced longitudinally apart from the first eccentric reamer, and wherein the at least a second eccentric reamer is positioned diametrically opposed to the first eccentric reamer on the drill pipe;

a first plurality of cutting teeth positioned along a plane that intersects the longitudinal axis of the drill pipe about each of the first eccentric reamer and the at least a second eccentric reamer, wherein a top of each successive tooth in a direction counter to a rotation of the apparatus in the well bore extends a radial distance from the longitudinal axis that is one of a) equal to a radial distance from the longitudinal axis of a preceding tooth and b) greater than the radial distance from the longitudinal axis of the preceding tooth, and wherein each tooth of the first plurality of cutting teeth is positioned at a different circumferential location about each of the first eccentric reamer and the at least a second eccentric reamer from the preceding tooth and the successive tooth of the first plurality of teeth; and, at least a second plurality of cutting teeth positioned along another plane that intersects the longitudinal axis of the drill pipe about each of the first eccentric reamer and the at least a second eccentric reamer, the at least a second plurality of cutting teeth being spaced latitudinally apart from the first plurality of teeth.

2. The apparatus of claim 1, wherein in the at least a second plurality of cutting teeth, a top of each successive tooth in a direction counter to a rotation of the apparatus in the well bore extends a radial distance from the longitudinal axis that is one of a) equal to a radial distance from the longitudinal axis of a preceding tooth and b) greater than the radial distance from the longitudinal axis of the preceding tooth.

3. The apparatus of claim 1, wherein each tooth of the second plurality of cutting teeth is positioned at a different circumferential location about each of the first eccentric reamer and the at least a second eccentric reamer from any adjacent teeth of the at least a second plurality of teeth.

4. The apparatus of claim 1, wherein at least one of the first eccentric reamer and the at least a second eccentric reamer further comprises at least one groove formed in a surface of the first eccentric reamer and the at least a second eccentric reamer.

5. The apparatus of claim 4, wherein a long axis of the groove, when viewed in profile, intersects at an acute angle the longitudinal axis of the drill pipe as the longitudinal axis extends downhole.

6. The apparatus of claim 4, wherein an uphole portion of the at least one groove is spaced longitudinally apart and at substantially a same circumferential position as a downhole portion of at least a second groove formed in the surface of at least one of the first eccentric reamer and the at least a second eccentric reamer.

7. The apparatus of claim 5, wherein the first plurality of cutting teeth and the at least a second plurality of cutting teeth, in combination, define a plurality of sets of teeth, and wherein each set defines a blade.

8. The apparatus of claim 7, wherein a center of each tooth of a first set of teeth of the plurality of sets of teeth is longitudinally spaced apart and positioned at a different circumferential location from a center of each tooth of an adjacent set of teeth of the plurality of sets of teeth.

9. The apparatus of claim 7, wherein the at least one groove separates a first set of teeth of the plurality of sets of teeth from at least a second set of teeth of the plurality of sets of teeth.

10. The apparatus of claim 9, where a width of the at least one groove is greater than a width of at least one blade defined by a set of the plurality of sets of teeth.

11. The apparatus of claim 1, wherein each successive tooth in a direction counter to a rotation of the apparatus of the first plurality of teeth is positioned at one of a) the same longitudinal position as the preceding tooth and b) longitudinally spaced apart from the preceding tooth by a distance measured from a center of the preceding tooth that is less than a radius of the preceding tooth.

12. The apparatus of claim 1, wherein at least a first tooth of the at least a second plurality of teeth is spaced longitudinally apart from at least a first tooth of the first plurality of teeth by a distance measured from a center of the at least a first tooth of the first plurality of teeth that is one of a) equal to and b) greater than a radius of the at least a first tooth of the first plurality of teeth.

13. The apparatus of claim 12, wherein at least the first tooth of the at least a second plurality of teeth is spaced longitudinally apart from at least a second tooth of the first plurality of teeth by a distance measured from a center of the at least a second tooth of the first plurality of teeth that is one of a) equal to and b) greater than a radius of the at least a second tooth of the first plurality of teeth.

14. The apparatus of claim 1, wherein a center of at least a first tooth of the at least a second plurality of teeth is spaced at a different circumferential location than a center of at least a first tooth of the first plurality of teeth.

15. The apparatus of claim 1, wherein a first plane extending through a center of each tooth of the first plurality of teeth, when viewed in profile, intersects at an acute angle the longitudinal axis of the drill pipe as the longitudinal axis extends downhole.

16. The apparatus of claim 1, wherein at least the first plurality of cutting elements are arranged along a spiral path along a surface of at least one of the first eccentric reamer and the at least a eccentric second reamer.

17. The apparatus of claim 1, wherein the at least a second eccentric reamer is positioned 180 degrees apart from the first eccentric reamer.

18. The apparatus of claim 1, wherein the apparatus is configured to pass through a drift diameter smaller than a drill diameter that the apparatus is capable of drilling.

* * * * *